United States Patent [19]

Bectarte

[11] Patent Number: 4,913,077

[45] Date of Patent: Apr. 3, 1990

[54] DISMOUNTABLE SAIL BOARD WHICH CAN BE USED AS A CRAFT THAT IS ALSO DISMOUNTABLE

[76] Inventor: Claude Bectarte, 6, Avenue de la Mer, 83700 Saint-Raphael, France

[21] Appl. No.: 199,403

[22] Filed: May 25, 1988

[51] Int. Cl.[4] ..... B63B 7/00

[52] U.S. Cl. ..... 114/354; 441/74

[58] Field of Search ..... 114/39.2, 354, 347, 114/352, 353; 441/74

[56] References Cited

U.S. PATENT DOCUMENTS 3,409,920 11/1968 Brownley ..... 441/74

3,996,868 12/1976 Schagen ..... 114/352

4,807,549 2/1989 Rhodes et al. ..... 114/352

*Primary Examiner*—Joseph F. Peters, Jr.

*Assistant Examiner*—Jesus D. Sotelo

*Attorney, Agent, or Firm*—Pollock, Vande Sande & Priddy

[57] ABSTRACT

A longitudinal groove is provided on each side of three elementary floats having the dimensions of the spars which will be housed therein. The flexing assembly, both at the front and at the rear part, is provided by tubular stirrups held in place by pins or the like. The structure is further designed to be used as a self-emptying small craft by adding a freeboard without transom.

14 Claims, 4 Drawing Sheets

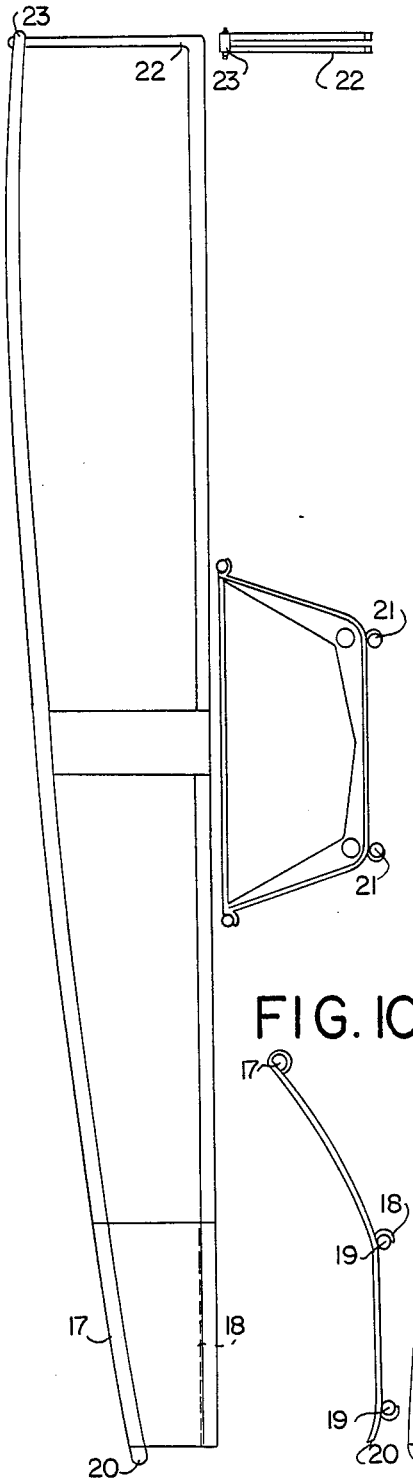
FIG. 10
FIG. 9
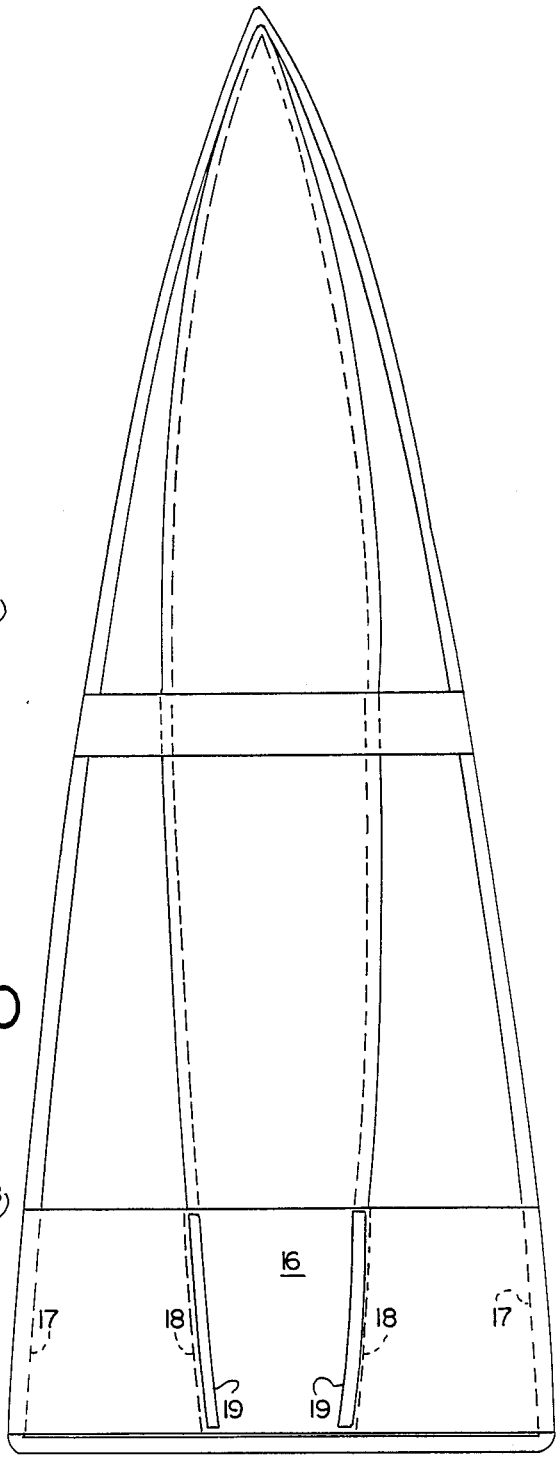
FIG. 8

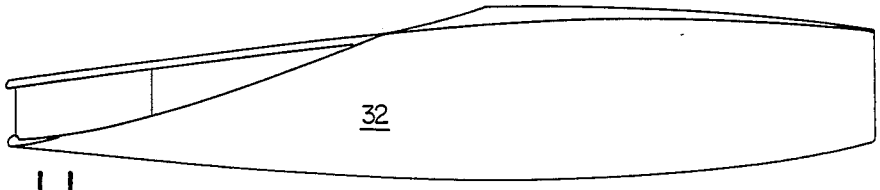
FIG. 11
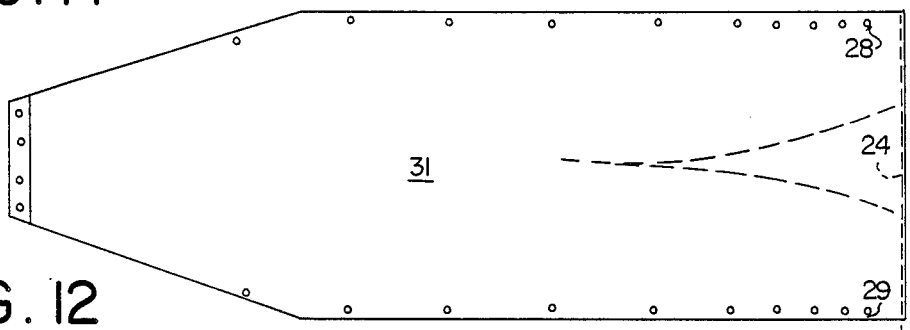
FIG. 12
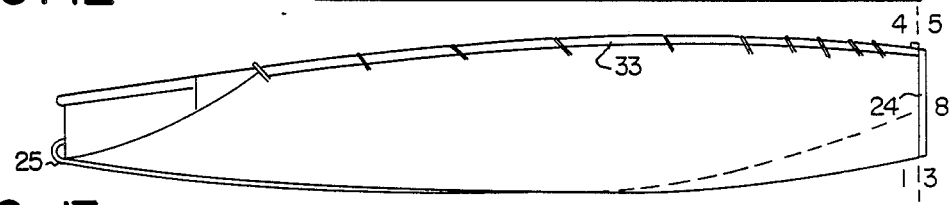
FIG. 13
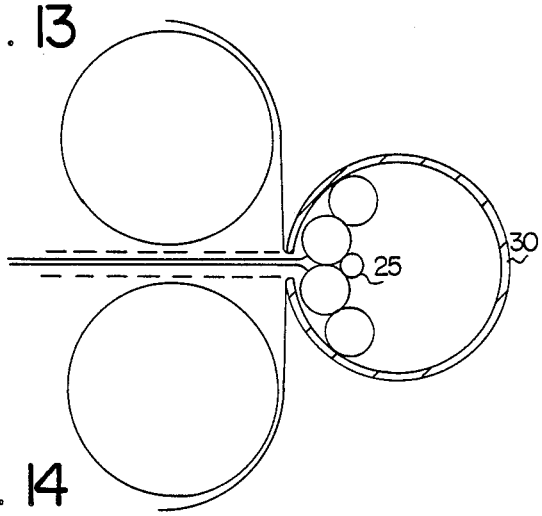
FIG. 14
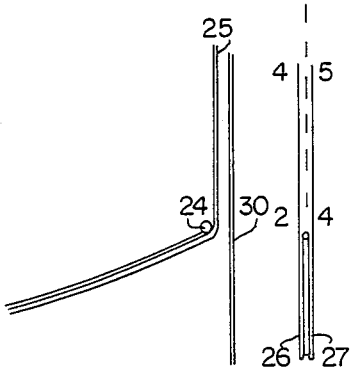
FIG. 15
FIG. 16

DISMOUNTABLE SAIL BOARD WHICH CAN BE USED AS A CRAFT THAT IS ALSO DISMOUNTABLE

FIELD OF THE INVENTION

The present invention relates to a disassemblable sail board transformable into a small craft that is also disassemblable and unsinkable, and having a variable geometry. It is intended for use by the leisure boating industry, and is particularly adapted for sailing craft that can be easily transported by plane.

BACKGROUND OF THE INVENTION

To date, collapsible sail boards have generally been of the inflatable type or have involved conventional hulls cut up into overlapping elements. The inventor is not aware of any use of such boards as basic elements in a sail craft which is itself disassemblable.

The technical problem involved with disassemblable boards has proved rather intractable, in the sense that the two known solutions have not satisfied demand. The first solution does not come sufficiently close to the production of the most efficient underwater hull shapes, while the second requires, at the junction points, laminate reinforcements which are hard to integrate into the foam.

With regard to the use of the boards, even in tandem, this is obviously limited by the absence of a freeboard, which alone can transform a beach device, even an unsinkable one, into a craft whose relative capacity and comfort permit more ambitious marine itineraries. French regulations governing navigational zones provide sufficient evidence to support this conclusion.

PURPOSE OF THE INVENTION

The present invention is intended to provide a multipurpose solution to these problems, one which is especially designed for the airborne tourist who desires a change of scene as well as physical relaxation. Essentially, it involves ensuring the connection between the floating elements of the boards, which are obviously of low density, by fitting them into the frame of the spars that are streamlined and assembled with flexion at their ends, of a size that guarantees, at minimum weight, sufficient resistance to the load, even in a multi-passenger version; and, with respect to use of the invention, to use spars as efficient anchoring points of an added framework, which is itself covered by a flexible envelope, that, among other advantages, permits variation of the surfaces of the underwater hull.

BRIEF DESCRIPTION OF THE DRAWINGS

In order that the invention may be more clearly understood, reference will now be made to the attached drawings, wherein an embodiment of the invention is shown for purposes of illustration, and wherein

FIG. 8 is a plan view of the framework;

FIG. 9 is a side view of the framework;

FIG. 10 shows three cross-section views in different planes;

FIG. 11 is a side view of the framework covered with a sheath type envelope;

FIG. 12 is a plan view of the envelope;

FIG. 13 is a side view of the framework covered with an envelope;

FIG. 14 is a front section view;

FIG. 15 is a vertical and axial section front view; and

FIG. 16 is a vertical and transverse section front view.

DESCRIPTION OF PREFERRED EMBODIMENT

Figures 1, 2, 3:
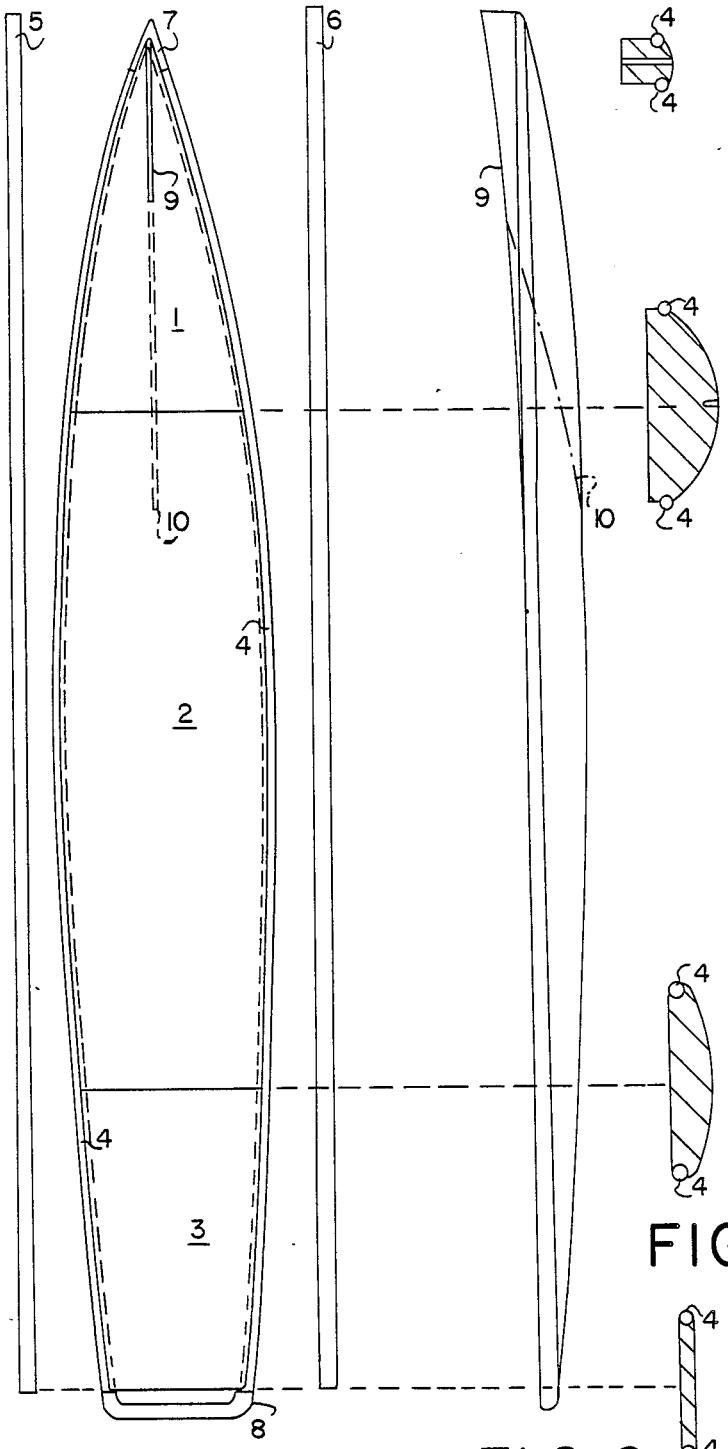
FIG. 1 is a plan view of the floats and the spars.
FIG. 2 is an overall side view.
FIG. 3 shows four cross-section views in different planes.
Figure 4:
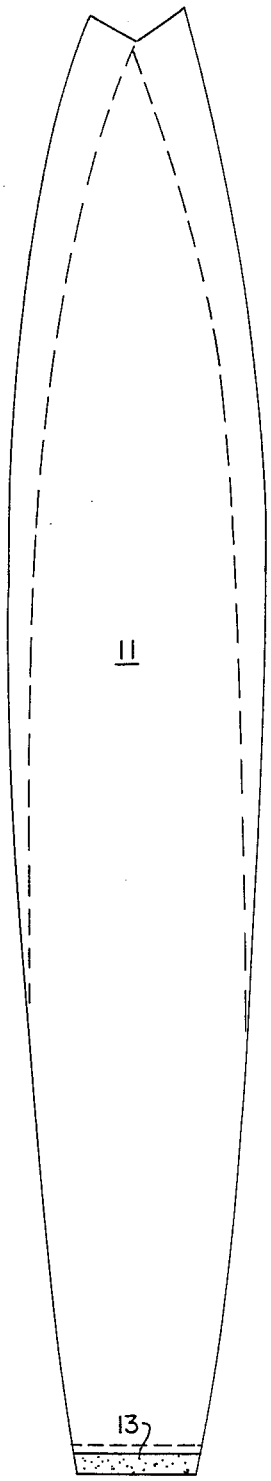
FIG. 4 is a plan view of the main cut-out of the envelope.
Figure 5:
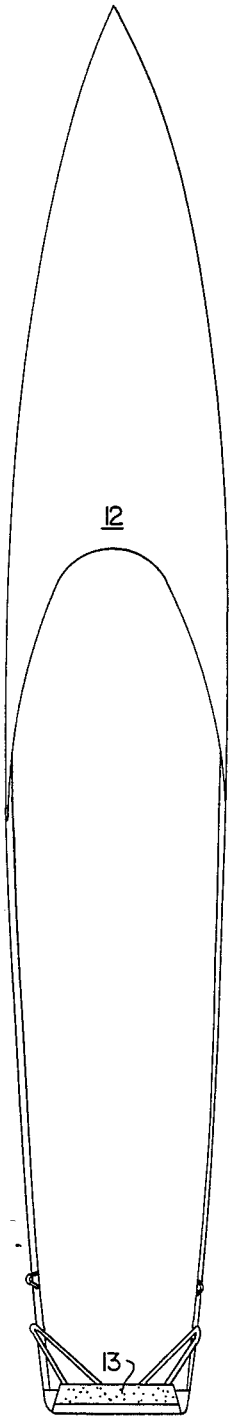
FIG. 5 is a plan view of the envelope fitted with its front cut-out.
Figure 6:
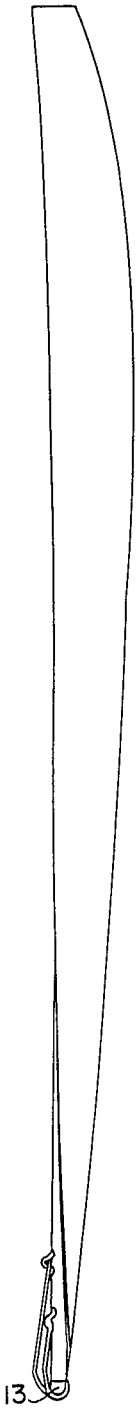
FIG. 6 is an overall side view, with the envelope cover.
Figure 7:
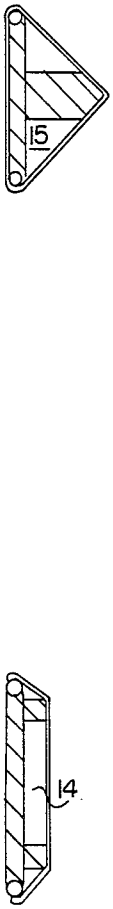
FIG. 7 shows two cross-section views.

As shown in FIG. 1, there are three basic floats (1 to 3). A longitudinal groove (4) of semi-circular section is provided on each side, having the same dimensions as the spars which will fit there. These spars (5, 6) are truncated tubes. The choice of two tubes of circular section is justified only by a concern for greater simplicity; the use of streamlined or spindle-shaped spars merely implies the reduction of the perimeter of the sections towards at least one of the ends.

The shape of the sections can be varied as a function of the desired performance and cost objectives. For example, an elliptical, polygonal or even eight-shaped section will provide greater rigidity at a given weight. Likewise, to obtain forward lines that are less taut, circular sections may be used in the middle, and elliptical ones towards the end. Finally, the frame which includes and compresses the basic floats may be constituted, according to production specifications, of one or more spars on each side, for instance, two tubular spars coupled vertically by slotted coupling plates, a solution that allows for assemblies of almost unlimited lengths.

The assembly in flexed position, both at the rear and the front, is made with tubular stirrups (7, 8), which are retained in position by pins or other fastening means.

The front stirrup is used as a pivot for a pivoting centerboard whose case, which is entirely open towards the front, is fitted beneath the affected floats, as shown at 9, 10.

In another embodiment, which is preferred for some purposes, a removable envelope made of flexible plastic foam with closed cells on a textile frame is used as a protective coating, and thus obviates the external layer of finish previously required to prevent rupture under load, and to alleviate, with its mechanical qualities, the intrinsic fragility of plastic foam or other low density materials.

Moreover, this type of coating, which is very light and the thickness of which can be varied at will, can contribute to the capacity to float, thus reducing and simplifying the internal rigid volumes since the final underwater hull lines are those of the envelope in position.

FIGS. 4 to 7 show the cut-out of the underside of the envelope (11) that covers the underside of the hull with a heavy thickness material; the cut-out of the top with a simple thickness material (12), and a profile view that highlights the rear lacing, by way of a reinforcement plate (13) that assures the longitudinal stress around the rear stirrup. The two sections (14) (15), finally, provide an example of the lightening effect produced by the floating envelope principle.

In use, the product, thus defined as a craft, requires the installation of a specially designed framework.

FIGS. 8 to 10 show the five constituent elements of the framework, i.e., the two upper spars supported by two frames and a stem.

(1) The stern frame (or transom according to conventional terminology) is both flexible in the transverse plane and rigid in the longitudinal plane; it is made up of a rectangular plate made of polycarbonate (16) the width of which is equal to that of the said board. This plate is fitted, on each side, with a hollow profile (17) having an internal section which corresponds to the external section of the upper spar housed therein. In parallel, on the same external side, it is also fitted with two groove profiles (18) which form a brace which holds the spars of the board when the stern frame slides, from the rear, into correct position. These profiles are riveted, through the flexible plate, to a series of flush deck sheaves (19).

The plate, thus positioned, is then curved upward, the arch thus formed being bent, not by a rope, but by a telescopic tube whose elbowed ends (20) are introduced in the ends of the upper spars. The width of that arch, and its anchoring mode on the board, are such that it is retained firmly in vertical position, thus acting as the stern post.

(2) The midship frame has, at its lower level, two grooves (21) which are analogous to those of the stern frame, even though they are shorter, and which have the same function once they slide into position. Independently of this fastening mode, an articulation, fitted with a blocking apparatus, can be housed in each of the two lower angles of the stern frame, so as to change the slope of the legs, and therefore, the width of the craft.

(3) The stem is comprised of a vertical stirrup that replaces the horizontal stirrup of the initial product. The tube at the end of the lower spars is elbowed, no longer in a single acute horizontal angle, but in two right angles (22) with parallel vertical sides, linked by an upper elbow (23) at zero degree.

(4) The end of the upper spars, which may be analogous to the lower spars, are attached on the stem, at the desired height, provided by means of a transverse spindle.

According to the simplest embodiment, the sail board thus fitted can be introduced inside a sheath (32) of the same kind as the one described above with reference to FIGS. 4 to 6, still tightened around the rear stirrup, but, obviously, with an increased capacity and the dimensions of a unit that is much more voluminous (see FIG. 11).

It can also be covered by an envelope (31) that is laterally tightened through lacing on the upper spars (33). The excess width of such envelope, which increases towards the stern, is drawn inwardly and pulled up to form a dart (in the clothing sense of the word) whose middle fold (24) occurs in the slit between the two vertical sides of the stem, and in the above-described centerboard casing (9, 10) dug out of the stern float. A cable (25) tightened between the stem and the rear maintains the fold in position.

The attachment of the envelope in front of the stem is ensured by way of a bolt rope which is inserted inside a slit tube, like the bolt rope of a sail in the groove of a mast. The difference centers on the capacity of the tube, which accommodates several thicknesses of bolt rope, instead of one.

FIG. 16, a transverse section between the stem and the tube, shows the two lateral folds (26, 27), and the four cloth and bolt rope thicknesses joined up to the level of the middle fold (24); from this point on, it remains only to join the two bolt-roped edges of the envelope, terminating in angles 28, 29.

FIG. 15, an axial longitudinal section view of the front, shows the itinerary of the stretch cable (25) which passes under the middle fold (24) and inside the tube (30).

FIG. 14, a horizontal life size section view, shows the tube (30) and its content, at the level of the middle fold.

The spacing of the edges of the slit of the tube must be sufficient to allow passage of the stretch cable (25).

In that version, it is possible to reduce the dimensions of the front freeboard by fastening the upper spars at the requisite level beneath the top of the stem: the excess fullness of the envelope is transferred to the middle fold, whose height increases as much as that of the front freeboard decreases.

I claim:

1. A disassemblable sail board for at least one passenger, adapted to be transformed into a craft, comprised of floats (1, 2, 3), fitted into a frame comprised of flexedly assembled, spindle-shaped spars (5, 6), said sail board having a framework (16 to 23) covered by a removable envelope (31).

2. A sail board according to claim 1, wherein the spars are assembled by a tubular front stirrup and a tubular rear stirrup (8).

3. A sail board according to claim 1, wherein the spars have circular cross-sections.

4. A sail board according to claim 1, wherein the spars have polygonal cross-sections.

5. A sail board according to claim 1, wherein the spars have elliptical cross-sections.

6. A sail board according to claim 1, wherein the spars have cross-sections whose shapes vary from middle to end.

7. A sail board according to claim 6, wherein the said cross-sections are circular in the middle and elliptical at the end.

8. A sail board according to claim 1, wherein a front stirrup (7) provides a pivot for a pivoting centerboard whose case (9, 10) is entirely open towards the front.

9. A sail board according to claim 1, wherein said framework includes a stern frame comprised of a flexible plate of variable curvature (16) and having a central part fastened to the board (18) and longitudinal edges (17) fastened along their entire length to upper spars (33) of said stern frame, and a stem slit by two elbows (22) connected by an upper elbow (23), having elbowed ends accommodating ends of said spars.

10. A sail board according to claim 9, wherein the envelope (31) has its edges (28, 29) laced around said upper spars (33), excess width of said envelope being withdrawn at the front by a tuck having a middle fold (24) which is pulled up inside said stem slit and into a centerboard casing (9, 10) by a cable (25).

11. A sail board according to claim 10, wherein attachment of the envelope (31) in front of the stem is ensured by way of a bolt rope inserted into a slit tube (30).

12. A sail board according to claim 1, wherein the floats (1, 2, 3) and the spars are inserted inside a sheath (11, 12, 13) made of flexible material.

13. A sail board according to claim 1, wherein the framework (16 to 23) is inserted inside a sheath (32) made of flexible material.

14. A sail board according to claim 1, wherein a midship frame of the framework is provided, at its bottom (21), with two joints which make it possible to vary the tilt of two side rails of said midship frame.

* * * * *